United States Patent [19]

Dastin

[11] Patent Number: 4,607,834

[45] Date of Patent: Aug. 26, 1986

[54] ADJUSTABLE SHEET GUIDE

[75] Inventor: Richard M. Dastin, Fairport, N.Y.

[73] Assignee: Xerox Corporation, Stamford, Conn.

[21] Appl. No.: 740,675

[22] Filed: Jun. 3, 1985

[51] Int. Cl.[4] ..... B65H 1/04; B65H 31/20

[52] U.S. Cl. ..... 271/171; 271/223

[58] Field of Search ..... 271/171, 223, 241, 253, 271/254, 255

[56] References Cited

U.S. PATENT DOCUMENTS

| | | | |
|---|---|---|---|
| 3,807,725 | 4/1974 | Bookless | 271/171 |
| 3,847,387 | 11/1974 | Sick | 271/171 |
| 4,097,042 | 6/1978 | Rozga | 271/171 |
| 4,174,103 | 11/1979 | Back et al. | 271/171 |
| 4,245,831 | 1/1981 | Michatek | 271/171 |
| 4,343,461 | 8/1982 | Tomimori | 271/22 |

FOREIGN PATENT DOCUMENTS

| | | | |
|---|---|---|---|
| 0131642 | 8/1982 | Japan | 271/171 |
| 280741 | 11/1927 | United Kingdom | 271/171 |

OTHER PUBLICATIONS

Xerox Disclosure Journal "System for Automatically Adjustable Side Guides", Collins, Joseph, vol. 1, Nos. 9/10, Sep./Oct. 1976, pp. 41 and 42.

*Primary Examiner*—Bruce H. Stoner, Jr.
*Assistant Examiner*—James E. Barlow
*Attorney, Agent, or Firm*—H. Fleischer; J. E. Beck; R. Zibelli

[57] ABSTRACT

A tray adapted to support a stack of sheet material thereon. The tray is adjustable to accommodate stacks of sheet material of different widths and lengths. The rear registration and the side registration surfaces are moved in unison with one another so as to engage the rear and side edges of the stack of sheet material respectively.

5 Claims, 5 Drawing Figures

ADJUSTABLE SHEET GUIDE

This invention relates generally to a sheet feeding apparatus employed in an electrophotographic printing machine, and more particularly concerns a tray for supporting thereon stacks of sheet material of different widths and lengths.

Generally, an electrophotographic printing machine is provided with one or more suitable sheet trays for supporting stacks of sheets arranged to be advanced, in seriatim, therefrom. The sheet trays are used to store copy sheets which will subsequently have a copy reproduced thereon or, as a temporary buffer storage, such as duplex trays, wherein the information has already been reproduced on one surface of the copy sheet and the sheet is stored within the duplex tray prior to being advanced therefrom to have the information reproduced on the other side thereof. These trays may include side guides and rear guides adapted to engage the side edge portion and rear edge portions of the stack of sheets disposed therein. In this way, the guides engage and align the side and rear edges of the stack. However, a problem often encountered with such devices is that the size of the stack of sheet varies. To this end, the guides are adapted to be moved to different discrete positions corresponding to the nominal size of the stack of sheets employed in the electrophotographic printing machine. Hereinbefore, in the case of a duplex tray, two motors were required to move the rear and side edge guides. One motor was dedicated for rear guide movement with the other motor being dedicated for side guide movement. With the increased competitiveness of todays copying machines, it is highly desirable to reduce the cost thereof without decreasing the functions therein. Thus, it would be extremely advantageous to be capable of utilizing a single motor for moving both the side edge guides and rear edge guide.

Various types of trays having adjustable guides thereon have been heretofore employed. The following disclosures appear to be relevant:

U.S. Pat. No. 3,807,725
Patentee: Bookless
Issued: Apr. 30, 1974

U.S. Pat. No. 3,847,387
Patentee: Sick
Issued: Nov. 12, 1974

U.S. Pat. No. 4,097,042
Patentee: Rozga
Issued: June 27, 1978

U.S. Pat. No. 4,174,103
Patentee: Back et al.
Issued: Nov. 13, 1979

U.S. Pat. No. 4,245,831
Patentee: Michatek
Issued: Jan. 20, 1981

U.S. Pat. No. 4,343,461
Patentee: Tomimori et al.
Issued: Aug. 10, 1982

The relevant portions of the foregoing disclosures may be briefly summarized as follows:

Bookless discloses an apparatus for separating spring biased side guides. A single lever including a cam is moved so as to adjust the side guides to a position wherein the operator may place a new stack of paper on the tray within the side guides.

Sick discloses an adjustable paper stack guide wherein rotation of the drive plate causes guide members, individually rotatable in 90° increments, to rotate. This varies the distance between the guide members allowing the apparatus to accommodate a range of different paper sizes.

Rozga discloses a backstop construction for a sheet stacking machine wherein a truck is positioned above a lift table and mounted to move from the front to the rear thereof. As the truck moves with respect to the frame, the position of the backstop is adjusted allowing the machine to accommodate different lengths of sheets.

Back et al. describes an adjustable magazine for holding a stack of sheets of different sizes therein. A cam is used to control the position of slicing plates and laterally displace the bottom of the tray. In this way, the magazine is adjustable to hold different size stacks of sheet material therein.

Michatek describes an adjustable tray with a plurality of flexible segments. The segments are movable in pairs from a depressed position to a raised position. When the segments are in the depressed position, they form a continuous surface with the tray. When the segments are in the raised position, they form side guides for the stack of sheets. In this way, the size of the tray may be suitably adjusted for different size stacks.

Tomimori et al. describes a paper feeding cassette with a movable bottom plate and a movable side plate to accommodate stacks of paper of varying widths.

In accordance with one aspect of the present invention, there is provide a tray for holding a stack of sheet material and being adjustable to accommodate stacks of sheet material of different widths and lengths. The tray includes a base plate for supporting the stack of sheet material thereon. Means, mounted movably on the base plate, define at least one side registration surface substantially normal to the base plate. Means, mounted movably on the base plate, define a rear registration surface substantially normal to the base plate with the plane defined by the rear registration surface being substantially normal to the plane defined by the side registration. Means are provided for moving the side registration means and the rear registration means in unison so as to simultaneously position the side registration surface in engagement with one side edge of the stack of sheet material and the rear registration surface in engagement with the rear edge of the stack of sheet material.

Pursuant to another aspect of the present invention, there is provided an electrophotographic printing machine of the type having a tray for holding a stack of sheet material adapted to have information reproduced thereon with the tray being adjustable to accommodate stacks of sheet material of different widths and lengths. The tray includes a base plate for supporting the stack of sheet material thereon. Means, mounted movably on the base plate, define at least one side registration surface substantially normal to the base plate. Means, mounted movable on the base plate, define a rear registration surface substantially normal to the base plate with the plane defined by the rear registration surface being substantially normal to the plane defined by the side registration surface. Means are provided for moving the side registration means and the rear registation means in unison so as to simultaneously position the side registration surface in engagement with one side edge of the stack of sheet material and the rear registration surface in engagement with the rear edge of the stack of sheet material.

Other features of the present invention will become apparent as the following description proceeds and upon reference to the drawings, in which.

While the present invention will hereinafter be described in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

Figure 1:
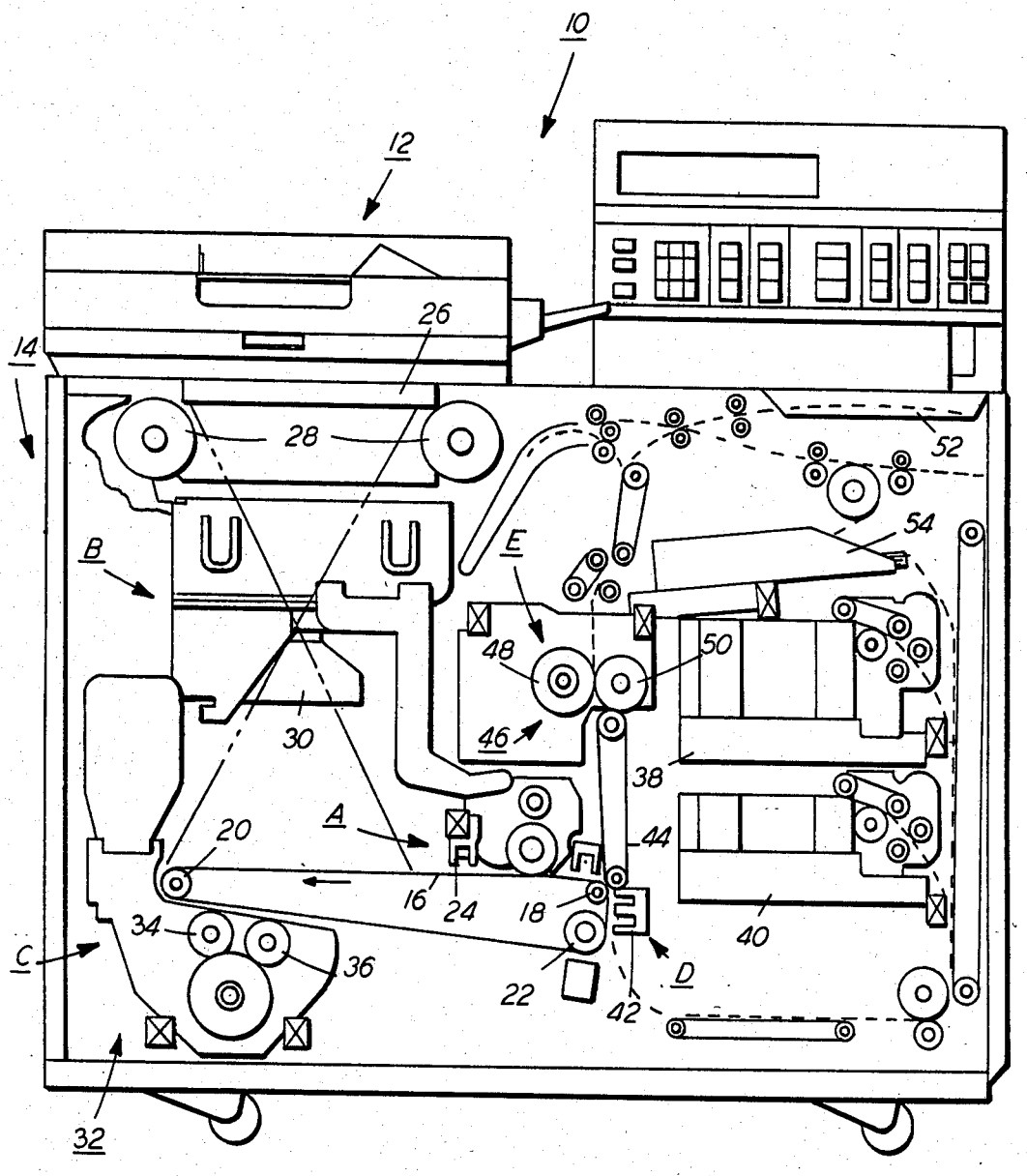
FIG. 1 is a schematic elevational view of an electrophotographic printing machine incorporating the features of the present invention therein.

For a general understanding of the features of the present invention, reference is made to the drawings. In the drawings, like reference numerals have been used throughout to designate identical elements. FIG. 1 is a schematic elevational view illustrating an electrophotographic printing machine incorporating the features of the present invention therein. It will become apparent from the following discussion that the stack support tray of the present invention is equally well suited for use in a wide variety of printing machines, and is not necessarily limited in its application to the particular embodiment shown herein.

Turning now to FIG. 1, printing machine 10 includes a recirculating document handling system 12 for advancing successive original documents onto the platen of the processing module 14. Inasmuch as the art of electrophotographic printing is well known, the operation of the various processing stations employed in processing module 14 will be described briefly.

Processing module 14 employs a belt 16 having a photoconductive surface deposed on a conductive substrate. Preferably the photoconductive surface is made from a selenium alloy with the conductive substrate being preferably made from an aluminum alloy which is electrically grounded. Belt 16 advances successive portions of the photoconductive surface sequentially through the various processing stations disposed about the path of movement thereof. Belt 16 is entrained about stripping roller 18, tensioning roller 20 and drive roller 22. Drive roller 22 is coupled to a suitable motor so as to rotate and advance belt 16.

Initially, a portion of belt 16 passes through charging station A. At charging station A, a corona generating device 24 charges the photoconductive surface of belt 16 to a relatively high, substantially uniform potential.

After the photoconductive surface of belt 16 is charged, the charged portion thereof is advanced through exposure station B. At exposure station B, an original document is advanced by the recirculating document handling system 12 to a transparent platen 26. Lamps 28 flash light rays onto the original document. The light rays reflected from the original document are transmitted through lens 30 forming a light image thereof. Lens 30 focuses the light image onto the charged portion of the photoconductive surface to selectively dissipate the charge thereon. This records an electrostatic image on the photoconductive surface of belt 16 which corresponds to the informational areas contained within the original document.

Thereafter, belt 16 advances the electrostatic latent image recorded on the photoconductive surface to development station C. At development station C a magnetic brush development system, indicated generally by the reference numeral 32, advances developer material into contact with the latent image. Preferably, magnetic brush development system 32 includes two magnetic brush developer rollers 34 and 36. Each roller advances developer material into contact with the latent image. These rollers form a brush of carrier granules and toner particles extending outwardly therefrom. The latent image attracts the toner particles from the carrier granules forming a toner powder image on the photoconductive surface of belt 16.

After the electrostatic latent image is developed, belt 16 advances the toner powder image to transfer station D. A sheet of support material is advanced to transfer station D from copy sheet stack supporting apparatus 38 or 40. Transfer station D includes a corona generating device 42 which sprays ions onto the backside of the copy sheet. This attracts the toner powder image from the photoconductive surface to the copy sheet. After transfer, the copy sheet moves onto conveyor 44 which advances the sheet to fusing station E.

Fusing station E includes a fuser assembly, indicated generally by the reference numeral 46, which permanently affixes the transferred powder image to the copy sheet. Preferably, fuser assembly 46 comprises a heated fuser roller 48 and a back-up roller 50. The copy sheet passes between the fuser roller and back-up roller with the toner powder image contacting the fuser roller. In this manner, the toner powder image is permanently affixed to the copy sheet. After fusing, the copy sheet is either advanced to output tray 52 or, returned to duplex tray 54 for subsequent recycling so as to enable a toner powder image to be transferred to the other side thereof. The detailed structure of duplex tray 54 will be described hereinafter with reference to FIGS. 2 through 5, inclusive.

Figure 2:
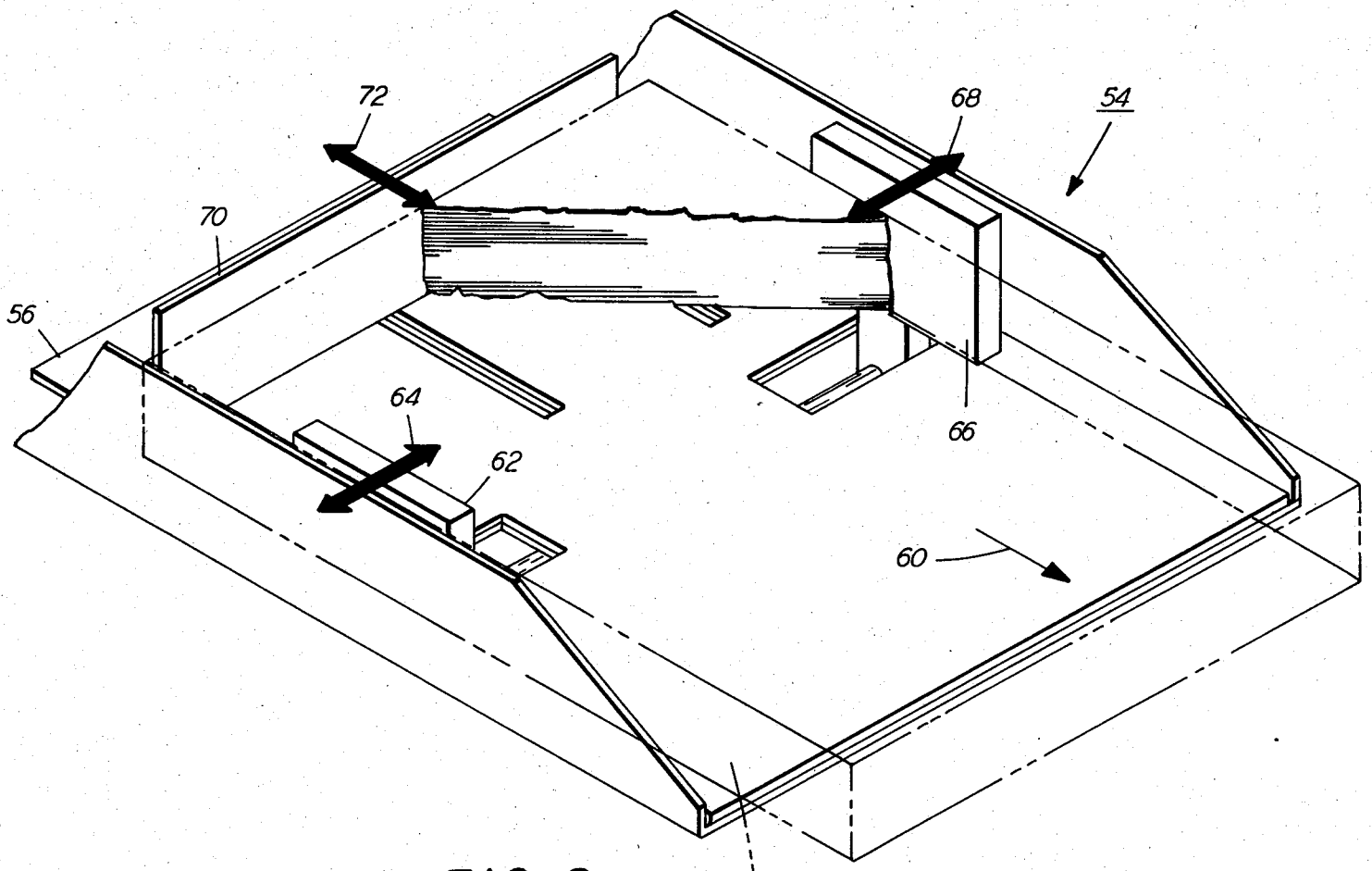
FIG. 2 is a fragmentary, perspective view showing the sheet tray used in the FIG. 1 printing machines.

Referring now to FIG. 2, there is shown a fragmentary, perspective view illustrating duplex tray 54 in greater detail. As depicted thereat, duplex tray 54 includes a base plate 56 adapted to receive successive copy sheets having a fused toner powder image formed on one side thereof.

The sheets form a stack 58 of sheet material which is supported on base plate 56. Successive sheets from stack 58 are advanced in the direction of arrow 60, in seriatim, by the sheet feeder (not shown). In this way, the sheets pass through the transfer station with the blank side contacting the photoconductive surface at transfer station D to have a toner powder image deposited thereon. Duplex tray 54, as shown in FIG. 2, is a center registration system. Thus, the center line of the stack of sheet material 58 is always located at a pre-selected position on base plate 56. This facilitates sheet feeding and insures proper registration of the sheet at the transfer station. A center registration system requires two movable edge guides which align and register the stack of sheets at the preferred location on base plate 56. Thus, edge guide 62 has a generally planar surface, normal to base plate 56, adapted to contact one side edge of stack 58. Edge guide 62 is mounted slidably on base plate 56 and moved in the direction of arrow 64. Similarly, edge guide 66 engages the other edge of stack 58. Edge guide 66 has a generally planar surface, normal to base plate 56, in engagement with the other side edge of stack 58. Edge guide 66 is also mounted slidably on base plate 56 to move in the direction of arrow 68. The distance between edge guide 62 and edge guide 66 corresponds to the width of the stack of sheet material supported on base plate 56. Edge guide 62 and edge guide 66 move in unison with one another and are adapted to move either inwardly toward one another or outwardly away from one another depending upon the size of the sheets being supported on base plate 56. In addition to edge guides 62 and 66, the stack must be properly positioned lengthwise with respect to base plate 56. This is achieved by rear guide 70. Rear guide 70 is mounted slidably on base plate 56 to move in the direction of arrow 72. In this way, the length of the area on base plate 56 may be adjusted so as to correspond to the length of the stack of sheet material 58 supported thereon. Rear guide 70 has a generally planar surface, normal to base plate 56 and to the planar surfaces of edge guides 62 and 66, adapted to be in engagement with the rear edge of stack 58. In this way, stack 58 is positioned lengthwise so as to be in a sheet feeding position. A suitable stepper motor and cam are employed to automatically position edge guides 62 and 66 and rear guide 70. The detailed structure of this arrangement is shown in FIG. 3.

Figure 3:
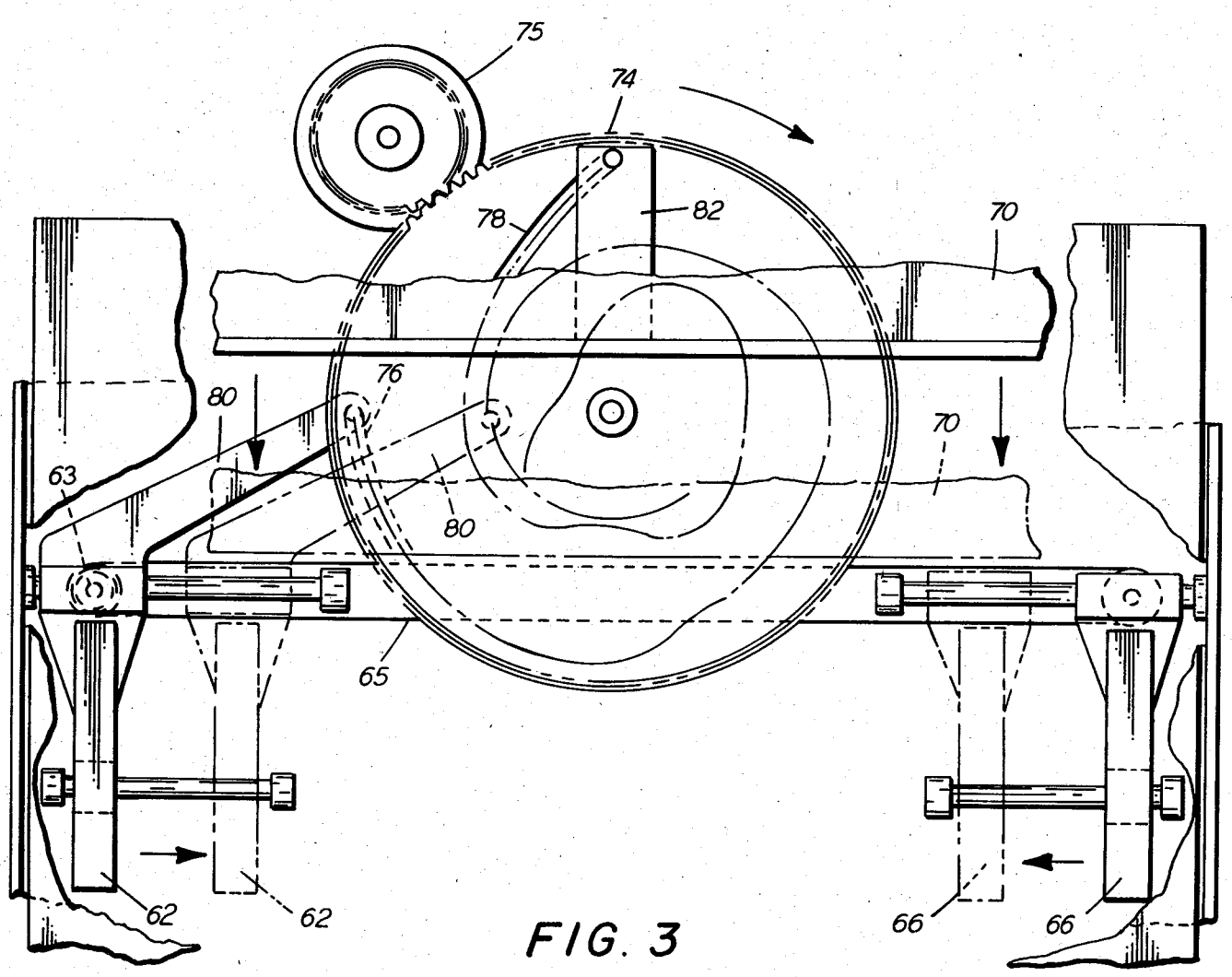
FIG. 3 is a fragmentary, plan view showing the cam and edge guides of the FIG. 2 tray.

Referring now to FIG. 3, cam 74 is driven by motor 75 coupled thereto. Cam 74 is a double face race track cam. Cam 74 has a bottom track or groove 76 therein and a top track or groove 78 therein. Cam followers 80 of edge guide 62 has a portion thereof adapted to ride in bottom cam track or groove 76. Cam follower 82, associated with rear guide 70, is adapted to ride in cam track or groove 78. Cam 74 is designed to allow the edge guide 62 and rear guide 70 to be positioned for twelve unique stack sizes. This cam design allows edge guide 62 to be adjusted independently of rear guide 70 while employing only one motor 75. Pulley 63 and belt 65 couple edge guide 66 to edge guide 62. In this way, as edge guide 62 moves inwardlly, edge 66 moves inwardly an equal distance. Similarly, as edge guide 62 moves outwardly, edge guide 66 moves outwardly an equal amount. Thus, as motor 75 rotates cam 74, guides 62 and 66 are moved inwardly toward one another or outwardly away from one another while rear guide 70 is moved to reduce the length of the stack or to increase the length of the stack. The detailed structure of cam 74 is shown in FIGS. 4 and 5.

Figure 4:
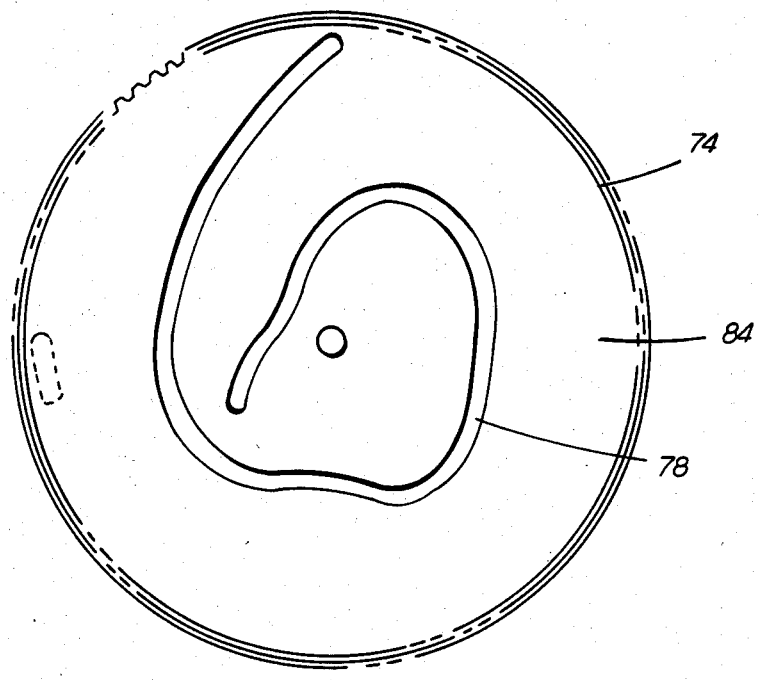
FIG. 4 is a top plan view of the FIG. 3 cam.

Referring now to FIG. 4, there is shown cam 74 in greater detail. As shown, thereat, cam 74 includes a surface 84 having track or groove 78 formed therein. Groove 78 is designed to receive the cam follower for rear guide 70. As cam 74 rotates, groove or track 76 controls the location of rear guide 70 with respect to base plate 56 (FIG. 2).

Figure 5:
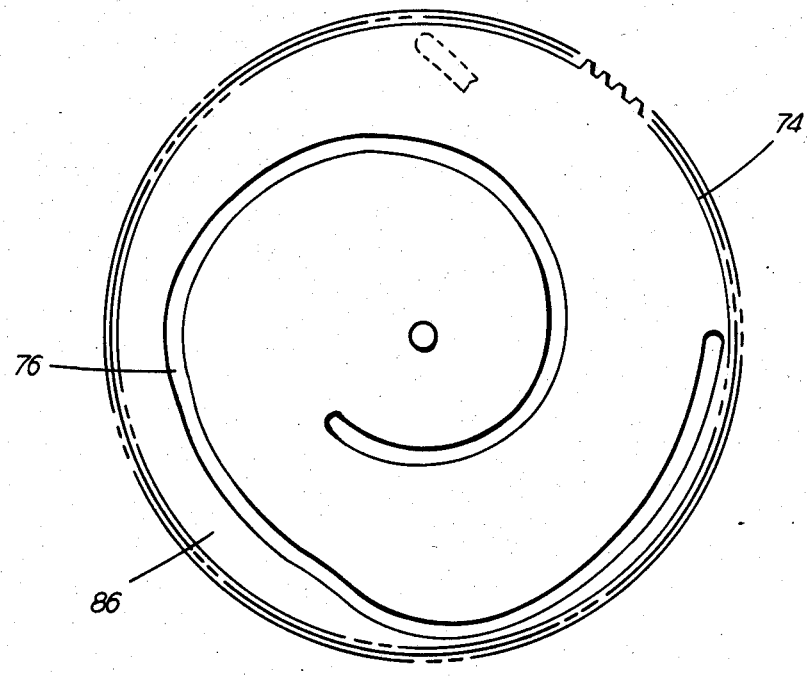
FIG. 5 is a bottom plan view of the FIG. 3 cam.

Referring now to FIG. 5, there is shown cam 74 with bottom surface 86 having groove or cam track 76 formed therein. Groove or cam track 76 is adapted to receive the cam follower coupled to side edge guides 62 and 60. In this way, as cam 74 rotates, groove 76 controls the position of side edge guides 62 and 66 with respect to base plate 56 (FIG. 2).

It is thus seen that cam 74 has two cam tracks or grooves cut on opposed surfaces thereof, which receive the respective cam followers of the side edge guides and rear edge guide. In this way, rotation of cam 74 controls the position of the rear edge guide and the side edge guides with respect to base plate 56. Thus, movement of the rear guides and side guides occurs simultaneously through rotation of cam 74.

One skilled in the art will appreciate that stepper motor 75 may be coupled to a controller which in turn, receives signals from sensors indicating the size of the copy sheets in copy sheet trays 40 and 38. Thus, depending upon the copy sheet tray selected, motor 75 may be controlled to rotate cam 74 the necessary angular rotation to move the side guides and rear guide such that the stack area of base plate 56 corresponds to the size of the copy sheet selected in tray 38 or 40. Furthermore, one skilled in the art will appreciate that although a duplex tray has been described as the preferred embodiment employing the features of the present invention any tray may utilize these features, for example, the copy sheet trays of the printing machine. Moreover, one skilled in the art will appreciate that a side registration system may also employ this technique. In this type of a system, one side guide is fixed and the other side guide is mounted slidably on the base plate. Thus, in the side registration system the cam would control the movement of one side guide and the rear guide rather than both side guides as is necessary in a center registration system.

In recapitulation, it is clear that the tray of the present invention is adjustable to accommodate stacks of sheet material of different widths and lengths. This adjustment is achieved by coupling the rear guide and side guides of the tray to a cam having cam tracks on opposed surfaces thereof. The cam is rotated by a stepper motor with the angular rotation of the cam controlling the location of the side guides and rear guide with respect to the base plate. This defines the area available on the base plate for receiving the stack. A system of this type significantly reduces the complexity and cost of the tray.

It is, therefore, apparent that there has been provided in accordance with the present invention a tray for holding stacks of sheet material of different widths and lengths that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations as fall within the spirit and broad scope of the appended claims.

I claim:

1. A tray for holding a stack of sheet material and being adjustable to accommodate stacks of sheet material of different widths and lengths, including:

a base plate for supporting the stack of sheet material thereon;

means, mounted movably on said base plate, for defining at least one side registration surface substantially normal to said base plate;

means, mounted movably on said base plate, for defining a rear registration surface substantially normal to said base plate with the plane defined by the rear registration surface being substantially normal to the plane defined by the side registration surface;

a drive motor;

a cam connected to said drive motor to rotate therewith, said cam having a first groove on one surface thereof and a second groove of a different profile than the first groove on the other surface thereof opposed therefrom;

a first cam follower mounted movably in the first groove of said cam and connected to said side registration means so that rotation of said cam by said drive motor moves said first cam follower to adjust the position of said side registration means to position the side registration surface in engagement with at least one side edge of the stack of sheet material on said base plate; and a second cam follower mounted movably in the second groove of said cam follower and connected to said rear registration means so that rotation of said cam by said drive motor moves said second cam follower to adjust the position of said rear registration means to position the rear registration surface in engagement with the rear edge of the stack of sheet material.

2. A tray according to claim 1, wherein said side registration means includes another side registration surface substantially normal to said said base plate being spaced from the first mentioned side registration surface and substantially parallel thereto.

3. A tray according to claim 1, wherein said cam is substantially cylindrical.

4. A tray according to claim 3, wherein said side registration means includes:

a first side plate mounted slidably on said base plate and being substantially normal thereto; and a second side plate mounted slidably on said base plate being substantially normal thereto and spaced from said first side plate, said first side plate and said second side plate being connected to one another to slide in unison.

5. A tray according to claim 4, wherein said rear registration means includes a rear plate mounted slidably on said base plate being substantially normal thereto and adapted to slide in a direction substantially normal to the direction of sliding of said first side plate and said second side plate.

* * * * *